US005653383A

United States Patent [19]

Adachi et al.

[11] Patent Number: 5,653,383

[45] Date of Patent: Aug. 5, 1997

[54] POURING SPOUT STRUCTURE FOR PAPER CARTON, PAPER CARTON HAVING POURING SPOUT, AND METHOD OF MANUFACTURING SUCH POURING SPOUT

[75] Inventors: Takuya Adachi; Masaki Tomihari; Noriyuki Sasaki; Takahisa Hirayama; Hideki Yamamoto; Yoshiaki Take; Yoshihiro Akima, all of Tokyo, Japan

[73] Assignee: Toppan Printing Co., Ltd., Tokyo, Japan

[21] Appl. No.: 524,406

[22] Filed: Sep. 6, 1995

[51] Int. Cl.[6] ..... B65D 43/02

[52] U.S. Cl. ..... 229/125.15; 220/359; 493/87; 493/923

[58] Field of Search ..... 229/125.15, 123.1, 229/238, 245; 220/271, 231, 359, 270; 215/262; 493/87, 89, 102, 214, 383, 962, 923

[56] References Cited

U.S. PATENT DOCUMENTS

| | | | |
|---|---|---|---|
| 3,977,591 | 8/1976 | Martensson et al. | 229/123.1 X |
| 4,595,116 | 6/1986 | Carlsson | 220/270 X |
| 4,781,323 | 11/1988 | Elias et al. . | |
| 4,792,069 | 12/1988 | Nantin et al. | 229/125.15 X |
| 4,798,296 | 1/1989 | Lagerstedt et al. | 229/125.15 X |
| 4,819,839 | 4/1989 | Carlsson et al. | 229/125.15 X |
| 5,452,849 | 9/1995 | Schramer et al. | 220/270 X |

FOREIGN PATENT DOCUMENTS

| | | | |
|---|---|---|---|
| 0312816 | 4/1989 | European Pat. Off. . | |
| 376612 | 7/1990 | European Pat. Off. | 229/123.1 |
| 194525 | 2/1965 | Sweden | 229/125.15 |

*Primary Examiner*—Allan N. Shoap
*Assistant Examiner*—Christopher J. McDonald
*Attorney, Agent, or Firm*—Armstrong, Westerman, Hattori, McLeland & Naughton

[57] ABSTRACT

In order to make the structure of the pouring spout simple by the use of a partial covering film, cover the inner peripheral surface around the pouring hole of the laminate base material properly, and prevent the contents from infiltrating into the inner peripheral surface around the pouring hole of the laminate base material, the present invention comprises the steps of attaching the inner waterproof layer and the partial covering film on the outer waterproof layer at the portion around the pouring hole, inside the pouring hole having penetrated through the laminate base material and the outer waterproof layer, boring a pouring spout on the attached portion, and attaching a tab tape to said partial covering film in a way capable of tearing off, so to cover the pouring spout.

16 Claims, 7 Drawing Sheets

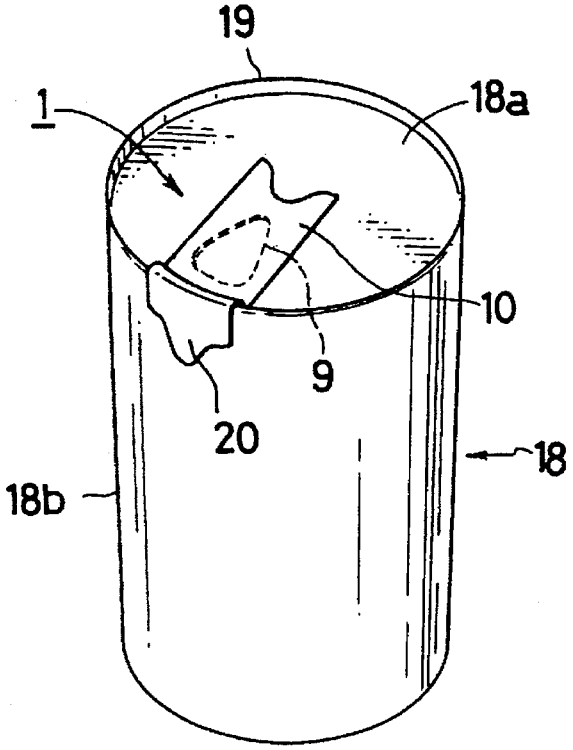
FIG-12
FIG-13
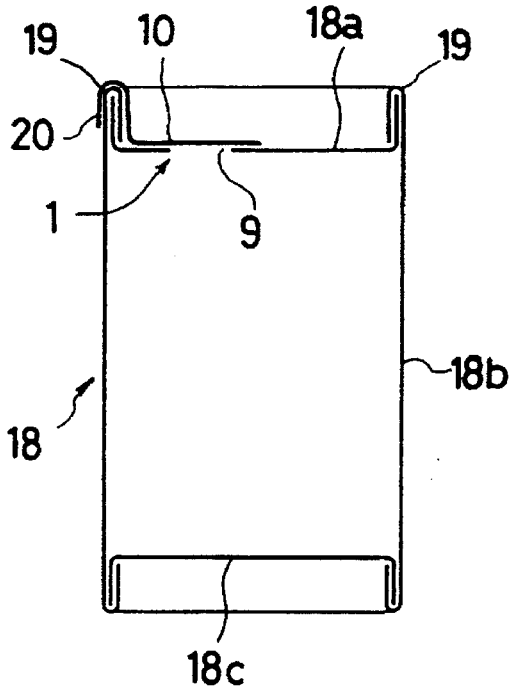
FIG-14
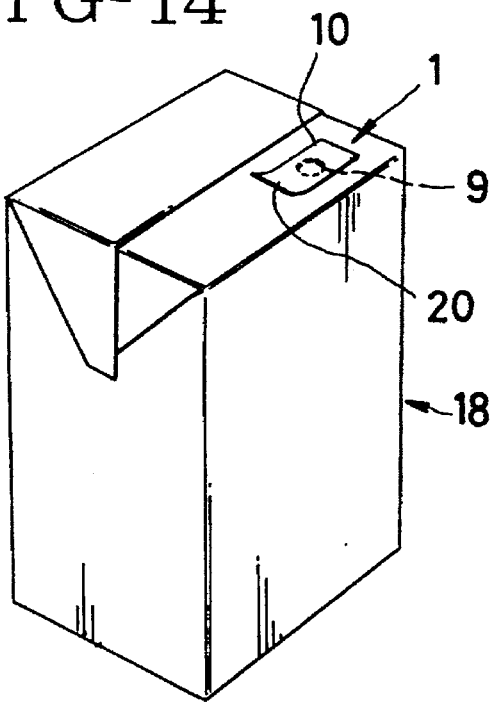

POURING SPOUT STRUCTURE FOR PAPER CARTON, PAPER CARTON HAVING POURING SPOUT, AND METHOD OF MANUFACTURING SUCH POURING SPOUT

BACKGROUND OF THE INVENTION

1. Field of the Invention

The present invention relates to a pouring spout structure for a paper carton, a paper carton having the pouring spout, and a method of manufacturing such a pouring spout.

2. Background Art

Recently, paper cartons of small volume have been widely used in the field of beverages such as fruit juice, coffee, soup, and fermented lactic-drink, because they are handy and can be easily disposed of after their use is finished. Some of these paper cartons have a pouring hole sealed with a tab tape to be torn off to open the carton. For the paper carton of the type described, various studies have been made in order to prevent the contents of the carton from entering into the inner peripheral surface defining a pouring hole, or a pouring spout. An example is disclosed in U.S. Pat. No. 4,595,116 of which structure is illustrated in FIG. 16. According to this art, the pouring spout 1 has a laminate base material 2 (a paper-based laminate). A hole 3 is formed in the laminate base material 2 by means of punching it to make a hole of a predetermined shape. Thermoplastic resin or the like is then laminated on one surface 4 facing outside the carton of the laminate base material 2 and the other surface 5 facing inside the carton to form an outer waterproof layer 6 and an inner waterproof layer 7, respectively. A pouring spout 9 is provided at an attached portion 8 where the waterproof layers 6 and 7 are attached to each other inside the above mentioned pouring hole. A tab tape 10 is removably attached to the outer waterproof layer 6 to cover the pouring spout 9.

Laminate materials, which form the main body of the carton with the waterproof layers provided on the outer and inner surfaces of the above mentioned laminate base material, have a laminated layer structure of selected synthetic resin or metal foil. The selection and combination of these materials permit the paper carton to have desired properties such as waterproof properties, water resistance, shading, and gas barrier properties.

However, in such a structure with the waterproof layers attached to each other in the pouring hole and a pouring spout to be covered with the tab tape, both waterproof layers attached by lamination cover the inner peripheral surface defining the pouring hole. Accordingly, a pinhole or a thinner portion of the layer may be formed depending on the status of the inner peripheral surface defining the pouring hole at the time of heat-sealing of the synthetic resins of the inner and outer waterproof layers. This often results in a faulty seal in the inner peripheral surface defining the hole and permits the contents of the carton to enter into the inner peripheral surface through a gap formed at the attached portion. In order to obtain the gas barrier properties around the pouring hole having no laminate base material laminated thereon, a laminate film may be made by an aluminum foil and an oriented polyester film used as the components of the above mentioned inner and outer waterproof layers, considering the gas barrier properties and strength of the film. However, these components typically have poor heat sealing characteristics relative to each other, so that the thermoplastic resin must be laminated on the above mentioned laminate film, which complicates the layer structure of the whole laminate film and raises the cost. Though the sealing properties may be improved by providing higher sealing strength, an excessively high sealing strength may cause the tab tape to be torn off along with the outer waterproof layer. As a result, the pouring spout may be whitened upon tearing off the tab tape. In addition, only the poor waterproof properties can be obtained.

The above mentioned problem can be solved with lower sealing strength. The lower sealing strength may, however, cause problems of the leaking of the contents or poor preservation properties.

With respect to the above problems, the present invention is directed to simplify the structure of the pouring spout using a partial covering film to cover the inner peripheral surface defining the hole of the laminate base material, and an object of the present invention is to easily obtain such a pouring spout that no contents enter into the inner peripheral surface defining the hole.

SUMMARY OF THE INVENTION

The present invention is thus made in consideration of the above mentioned problems, and, in order to solve the above mentioned problems, there is provided a pouring spout structure of a paper carton comprising a laminate base material; an outer waterproof layer formed on one surface facing outside the carton of the laminate base material, the laminate base material and the outer waterproof layer being provided with a hole formed therein and penetrating therethrough; an inner waterproof layer formed on the outer surface facing inside the carton of the laminate base material, the inner waterproof layer being extended over the hole and provided with an inner waterproof pouring hole formed therein and penetrating therethrough, the inner waterproof pouring hole being smaller than the hole; a partial covering film attached to the outer waterproof layer along the periphery of the hole such that the partial covering film covers the hole extending over the pouring hole, the partial covering film being provided with a partial covering film pouring hole formed therein and penetrating therethrough, the partial covering film pouring hole being smaller than the hole and corresponding to the inner waterproof pouring hole, the inner waterproof layer and the partial covering film being attached as an attached portion at the periphery of the inner waterproof pouring hole and the partial covering film pouring hole; a spout portion provided in the pouring hole and defined by the edge of the attached portion, the attached portion covering the inner peripheral surface defining the hole; and a tab tape removably attached to the partial covering film, the spout portion being covered with the tab tape.

According to another aspect of the present invention, there is provided a pouring spout structure of a paper carton comprising a laminate base material; an outer waterproof layer formed on one surface facing outside the carton of the laminate base material; an inner waterproof layer formed on the other surface facing inside the carton of the laminate base material, the laminate base material, the outer waterproof layer, and the inner waterproof layer being provided with a hole formed therein and penetrating therethrough; an outer partial covering film attached to the outer waterproof layer along the periphery of the pouring hole such that the outer partial covering film covers the hole extending over the pouring hole, the outer partial covering film being provided with an outer partial covering film hole formed therein and penetrating therethrough, the outer partial covering film pouring hole being smaller than the pouring hole; an inner partial covering film attached to the inner waterproof layer along the periphery of the hole such that the inner partial covering film covers the hole extending over the pouring hole, the inner partial covering film being provided with an inner partial covering film pouring hole formed therein and penetrating therethrough, the inner partial covering film pouring hole being smaller than the hole and corresponding to the outer waterproof pouring hole, the outer and inner partial covering films being attached as an attached portion at the periphery of the outer and inner partial covering film pouring holes; a spout portion provided in the hole and defined by the edge of the attached portion, the attached portion covering the inner peripheral surface defining the hole; and a tab tape removably attached to the outer partial covering film, the spout portion being covered with the tab tape.

Thus, in the present invention, the inner peripheral surface defining the hole is covered with the attached portion formed of the extended inner waterproof layer and window-shaped stick film. Alternatively, the inner peripheral surface defining the hole is covered with the attached portion formed of the outer and inner partial covering films. These structures prevent the contents of the container from entering into the above inner peripheral surface. Accordingly, a layered film having gas barrier properties and strength can be used as the partial covering film without a significant increase of the manufacturing cost for the whole body of the carton because such a partial covering film is to be attached only along the hole. As mentioned above, the tab tape covers the spout portion placed inside the pouring hole, the spout portion is appeared by tearing off the tab tape so to open the pouring spout.

Furthermore, a ring-shaped heat sealed lacquer layer may be provided on the outer surface of the outer partial covering film and the tab tape may be removably attached to the partial covering film through the head seal lacquer layer.

The partial covering film may have a multi-layered structure. The inner waterproof layer extended over the hole and the inner partial covering film may be formed in a multi-layered structure including a film having gas barrier properties. In addition, the inner and outer partial covering films may be formed in a multi-layered structure including a film having gas barrier properties.

The outer partial covering film may be formed in a multi-layered structure including a film having a good mechanical strength. It may be formed in a multi-layered structure including layers to be separated from each other at the time of tearing off the tab tape, or in a multi-layered structure including a white colored film.

In the present invention, there is also provided a paper carton in which the pouring spout of the above mentioned structure is provided in the top surface of the paper carton having a brick shape. Alternatively, the pouring spout of the above mentioned structure may be provided in the inclined top surface of a gable-top paper carton. Furthermore, the pouring spout of the above mentioned structure may be provided the top surface of the paper carton having a cylindrical trunk portion.

Moreover, in the cylindrical paper carton according to the present invention, the circular top surface has an outer flange portion, and the tab tape is extended outward from the pouring spout beyond the outer flange portion. In addition, in the brick-shaped, gable-top, or cylindrical paper carton, the tab table has a picking-up portion at the distal end thereof.

According to yet another aspect of the present invention, there is provided a method of manufacturing a pouring spout of a paper carton comprising the steps of laminating an outer waterproof layer on one surface facing outside the paper carton of a laminate base material; forming a pouring hole penetrating through the laminate base material and the outer waterproof layer; laminating an inner waterproof layer on the other surface facing inside the paper carton of the laminate base material where the hole was formed; attaching a partial covering film which is larger than the hole, from the exposed portion of the inner waterproof layer through the hole to a flange portion of the outer waterproof layer around the hole, thereby covering the inner peripheral surface defining the hole with the inner waterproof layer and the partial covering film; forming a spout portion penetrating through the partial covering film and the inner waterproof layer in the area where the partial covering film is attached to the inner waterproofing layer; and removably attaching a tab tape to the partial covering film to cover the spout portion with the tab tape. Another aspect of the present invention comprises the steps of laminating an outer waterproof layer and an inner waterproof layer on one surface facing outside the paper carton of a laminate base material and the other surface facing inside the paper carton; forming a pouring hole penetrating through the laminate base material, the outer waterproof layer, and the inner waterproof layer; placing partial covering films outwardly and inwardly relative to the hole, the partial covering films being larger than the hole and attached to each other in the hole, the partial covering film being also attached to the waterproof layers around the hole for covering the inner peripheral surface with the inner and outer partial covering films; forming a spout portion penetrating through the partial covering films in the area where the partial covering films are attached to each other; and removably attaching a tab tape to the partial covering film to cover the spout portion with the tab tape. According to these methods of manufacturing the pouring spout, the inner peripheral surface defining the hole is covered with the attached portion formed of the extended inner waterproof layer and window-shaped stick film. Alternatively, the inner peripheral surface defining the hole is covered with the attached portion formed of the outer and inner partial covering films. These structures prevent the contents of the container from entering into the above inner peripheral surface. When the spout portion positioned ins the pouring hole is covered with the tap tape, the pouring spout is sealed with the tab tape.

BRIEF DESCRIPTION OF THE DRAWINGS

FIG. 12 is a view for use in describing a cylindrical paper carton;

FIG. 13 is a view showing a cross section of the cylindrical paper carton;

FIG. 14 is a view for use in describing a brick-shaped paper carton;

DETAILED DESCRIPTION OF THE PREFERRED EMBODIMENTS

Figure 16:
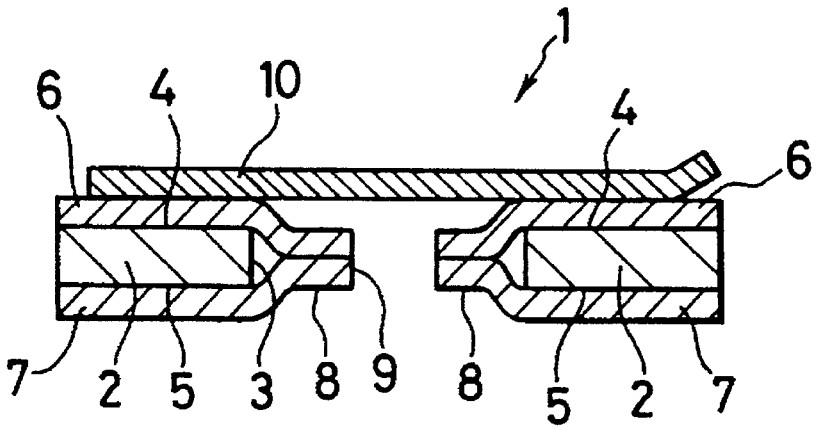
FIG. 16 is a view for use in describing a conventional art.

Next, the present invention is described more in detail in conjunction with embodiments thereof illustrated in the drawing. In the figures, similar components and parts are indicated by like reference numerals to the conventional ones in FIG. 16, and explanation thereof will be omitted.

A laminate base material 2 for a paper carton is formed by means of laminating synthetic resin or a synthetic resin film on a paper board which serves as a main material. A thin metal film layer, a metal deposited layer, or a metal oxide deposition layer may be formed thereon depending on the applications of the paper carton. For example, the laminate base material 2 consists of a paper board layer (220 g/m$^2$), a polyethylene layer (20 μm thick), a polyethylene layer (15 μm thick), a biaxial oriented polyethylene terephthalate film layer (12 μm thick), and a silicon oxide deposited thin layer (400 Å thick) laminated in this order from the outside of the paper carton to the inside thereof.

Figure 1:
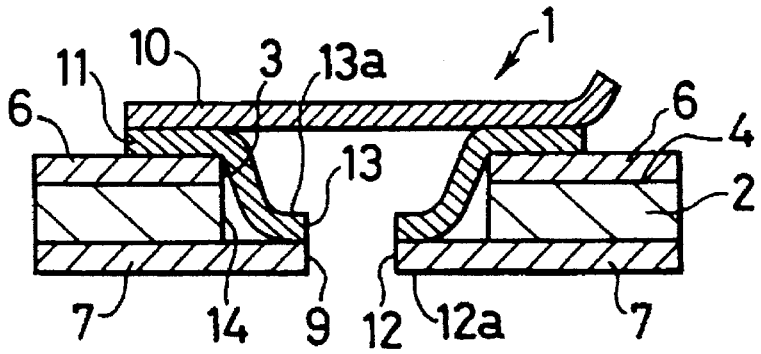
FIG. 1 is a view for use in describing one embodiment of a pouring spout structure for a paper carton according to the present invention.

In the structure of a pouring spout 1 according to the present invention, as illustrated in FIG. 1, a hole 3 is provided through the above mentioned laminate base material 2 and an outer waterproof layer 6 laminated on one surface 4 facing outside the paper carton of the laminate base material 2. The outer waterproof layer 6 may be, for example, a single low density polyethylene layer 60 of μm thick formed by extrusion-laminate. At the inside the hole 3, an inner waterproof layer film **7*a* serving as a laminated inner waterproof layer 7 is extended across the hole 3. Formed in the inner waterproof layer 7 is an inner waterproof layer pouring hole 12 which is smaller than the hole 3. The inner waterproof layer 7 comprises, for example, an adhesive resin layer, a gas barrier film having gas barrier properties and a laminate film having laminated plies of synthetic resin films which are laminated in this order from the side of the laminate base material. However, the inner waterproof layer 7 may be a single layer of polyethylene such as low density polyethylene or linear low density polyethylene. If necessary, a polyester copolymer may be used for the single layer of this inner waterproof layer 7**.

The reference numeral 11 in the figure indicates a partial covering film. The partial covering film 11 is attached to the portion around the pouring hole in the outer waterproof layer 6 and is extended toward the inside of the pouring hole. A partial covering film pouring hole 13 is formed in the partial covering film 11 which the pouring hole 13 is smaller than the hole 3 and corresponds to the inner waterproof layer pouring hole 12. As will be described later, the partial covering film 11 may be made of a film having a multi-layered structure. However, the partial covering film 11 may be a single layer of polyethylene such as low density polyethylene or linear low density polyethylene. If necessary, a polyester copolymer may be used for the single layer of this partial covering film 11.

At the pouring spout 1, flange portions **12*a* and 13*a* of the pouring holes 12 and 13 in the inner waterproof layer and the partial covering film, respectively, are attached to each other as an attached portion to define a spout portion 9 inside the hole 3. An inner peripheral surface 14 defining the hole 3 is covered with the partial covering film 11 and the inner waterproof layer 7 (the inner waterproof layer film) whose flange portions 12*a* and 13*a*** are being attached to each other.

As mentioned above, the inner peripheral surface 14 is covered with the extended portions of the inner waterproof layer 7 and the partial covering film 11. These extended portions, or the above mentioned flange portions **12*a* and 13*a* are attached to each other as the attached portion. Such structure prevents the contents of the paper carton from entering into the inner peripheral surface 14 defining the hole 3. With respect to the partial covering film 11, a tab tape 10 is removably attached to the outer periphery of the partial covering film 11 as in the conventional art described above. The tab tape 10 thus covers the spout portion 9**.

Figure 2:
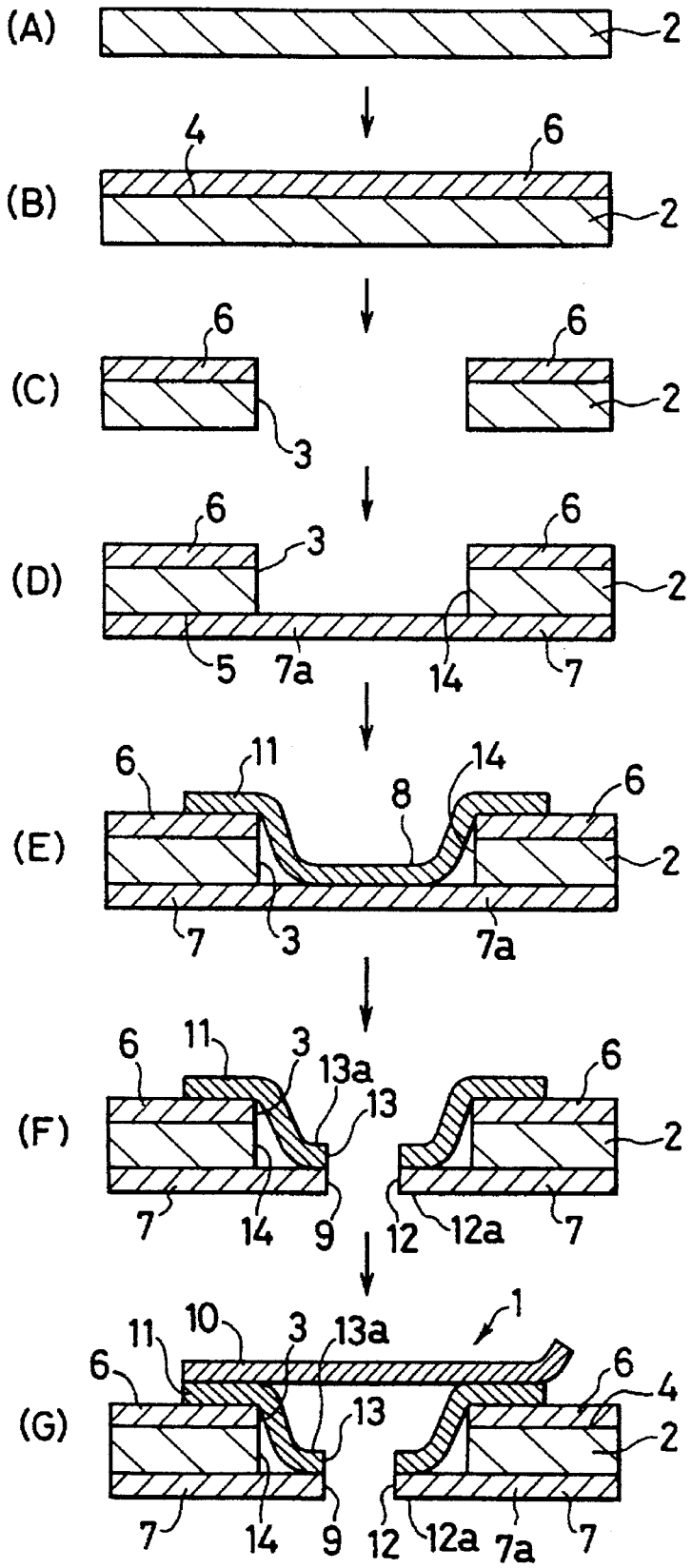
FIG. 2 is a view illustrating steps of manufacturing the pouring spout structure of FIG. 1, in which (A) is a view showing a laminate base material, (B) is a view showing the laminate base material with an outer waterproof layer formed thereon, (C) is a view of the laminates in which a hole is formed, (D) is a view showing the laminate base material with an inner waterproof layer formed thereon, (E) is a view showing a partial covering film attached to the laminates, (F) is a view showing a spout portion formed through the laminates, and (G) is a view showing the pouring spout with a tab tape attached thereto.

The pouring spout 1 having the above mentioned structure may be obtained through the following steps as illustrated in FIG. 2. First, the laminate base material 2 is provided in a sheet shape (A). The outer waterproof layer 6 is formed on one surface 4 facing outside the paper carton of the laminate base material 2 by means of laminating directly a desired resin or a laminate film formed of desired resin layers (B). After the above mentioned waterproof layer 6 is formed, a hole 3 is formed through the laminate base material 2 and the outer waterproof layer 6 at a predetermined position (C).

Next, on the other surface 5 facing inside the paper carton of the laminate base material 2, an inner waterproof layer 7 is formed by means of laminating an inner waterproof layer film having layers of desired resin and a barrier material such that the above inner waterproof layer 7 is extended across the hole 3 (D). Then, the partial covering film 11, which is larger than the hole 3 for covering the hole 3, is attached by the head sealing technique from the exposed portion of the inner waterproof layer 7 across the hole 3 to the outer waterproof layer 6 around the flange portion of the pouring hole (E). This partial covering film 11 is a laminate film, in which a thermoplastic resin represented by the polyethylene resin is deposited at least on the surface thereof contacting with the inner waterproofing layer film 7*a* to provide good heat sealing properties between the partial covering film 11 and the upper resin layer of the inner waterproof layer film forming the inner waterproof layer 7.

After having obtained the attached portion 8 inside the hole 3 by means of attaching the partial covering film 11 to the inner waterproof layer 7, the spout portion 9 is formed through the partial covering film 11 and the inner waterproof layer 7 in this attached portion 8 (F). No gap is formed at the flange portion of the spout portion 9 because the flange portion 13*a* of the partial covering film 11 and the flange portion 12*a* of the inner waterproof layer 7 are fused by heat. This heat sealing prevents the contents from entering into the inner peripheral surface defining the pouring hole.

After having formed the spout portion 9 in the manner described above, a paper carton is made of this laminate material. More specifically, a "carton blank" to be formed into the paper carton is filled with the contents by using a filling machine. After having finished filling, a tab tape 10 is heat-sealed as shown in (G) to the partial covering film 11 at the position corresponding to the outer waterproof layer 6 (outer peripheral portion of the partial covering film 11) to cover the spout portion 9. As a result, the spout portion 9 to be opened is provided and the paper carton is completely formed. Alternatively, the tab tape may be previously sealed to the carton blank before filling the contents. The tab tape 10 has, at least on the side facing the partial covering film 11, a layer that allows heat sealing to the tab tape to the partial covering film 11.

According to the above embodiment, the partial covering film extended inwardly from the outside the paper carton is attached to the inner waterproof layer to cover the inner peripheral surface defining the pouring hole. However, the partial covering films may be extended inwardly and outwardly of the paper carton and attached to each other in the pouring hole to cover the inner peripheral surface defining the pouring hole.

Figure 3:
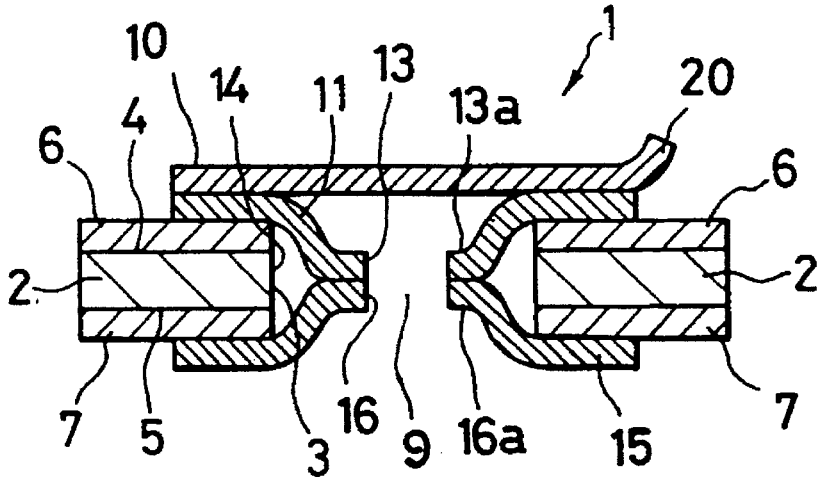
FIG. 3 is a view for use in describing another embodiment of a pouring spout structure for a paper carton according to the present invention.
Figure 4:
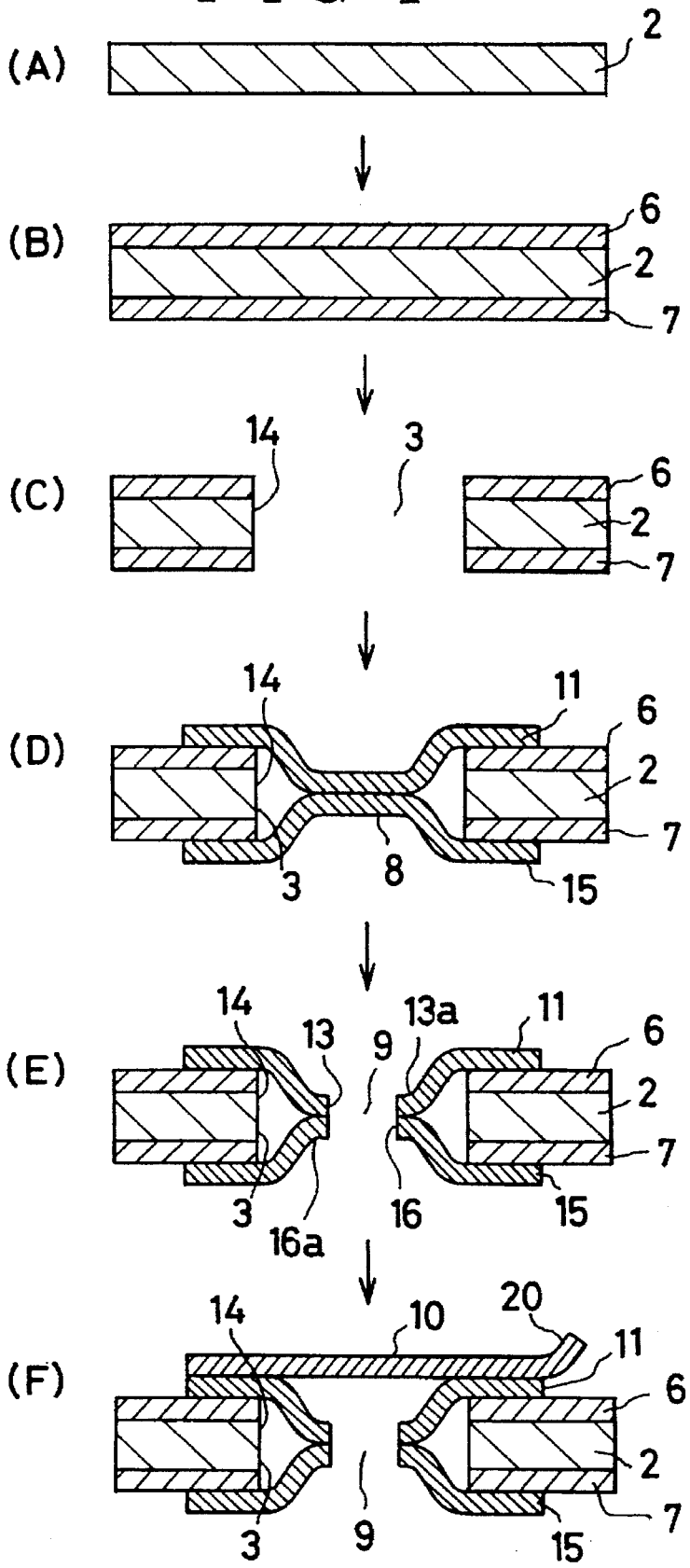
FIG. 4 indicates the manufacturing procedure of the structure of the pouring spout of FIG. 3, in which (A) is a view showing a laminate base material, (B) is a view showing the laminate base material with inner and outer waterproof layers formed thereon, (C) is a view of the laminates in which a hole is formed, (D) is a view showing a partial covering film attached to the laminates, (E) is a view showing a spout portion formed through the laminates, and (F) is a view showing the pouring spout with a tab tape attached thereto.

FIGS. 3 and 4 indicate the structure of the pouring spout 1 with the partial covering films attached to each other from inside and outside of the paper carton. As shown in FIG. 3, a hole 3 is provided through the above mentioned laminate base material 2, an outer waterproof layer 6 laminated on one surface 4 facing outside the paper carton of the laminate base material 2, and an inner waterproof layer 7 laminated on the other surface 5 facing inside the paper carton of the laminate base material 2. The outer and inner waterproof layers 6 and 7 may be, for example, a single low density polyethylene layer 60 of μm thick formed by extrusion-laminate.

A partial covering film 11 is attached to the outer waterproof layer 6 at the position along the periphery of the pouring hole to cover the hole 3 from the outside of the paper carton. In addition, another partial covering film 15 is attached to the inner waterproof layer 7 at the position along the periphery of the pouring hole to cover the hole 3. Further, the inner and outer partial covering films 11 and 15 are attached to each other inside the hole 3. Then, at the attached portion of the partial covering films, a pouring hole 13 of the partial covering film smaller than the hole 3 is formed in the outer partial covering film 11, and a pouring hole 16 of the partial covering film smaller than the hole 3 is formed in the inner partial covering film 15. Both pouring holes 13 and 16 in the above partial covering films are overlapped and communicated with each other. The partial covering films 11 and 15 may be made of a film having a multi-layered structure. However, the partial covering films 11 and 15 may be a single layer of polyethylene such as low density polyethylene or linear low density polyethylene. If necessary, a polyester copolymer may be used for the single layer of these partial covering films 11 and 15.

As shown in the figure, flange portions 13*a* and 16*a* of the pouring holes 13 and 16 in the outer and inner waterproof layers, respectively, are attached to each other as an attached portion to define a spout portion 9 inside the hole 3. An inner peripheral surface 14 is covered with the partial covering films 11 and 15 whose flange portions 13*a* and 16*a* are being attached to each other. This structure ensures tight sealing against the inner peripheral surface 14 defining the hole 3.

As mentioned above, the inner peripheral surface 14 is covered with the extended portions of the partial covering films 11 and 15. These extended portions, or the above mentioned flange portions 13*a* and 16*a* are attached to each other as the attached portion. Such structure prevents the contents of the paper carton from entering into the inner peripheral surface 14 defining the hole 3. With respect to the partial covering film 11, a tab tape 10 is removably attached to the outer periphery of the partial covering film 11 as in the above mentioned embodiment.

As one example, the tab tape 10 may be formed of layers including a biaxial oriented polyethylene terephthalate film layer (12 μm thick), a silicon oxide deposited thin film layer (400 Åthick), and a polyethylene layer (40 μm thick) laminated in this order from the outside of the paper carton. Alternatively, the tab tape 10 may be formed of layers including a biaxial oriented polyethylene terephthalate film layer (12 μm thick), an aluminum layer (50 μm thick), and a polyethylene layer (40 μm thick) laminated in this order from the outside of the paper carton.

The pouring spout 1 having the above mentioned structure may be obtained through the following steps as illustrated in FIG. 4. First, the laminate base material 2 is provided in a sheet shape (A). The outer and inner waterproof layers 6 and 7 are formed on one surface 4 facing outside the paper carton of the laminate base material 2 and the other surface 5 facing inside the paper carton of the laminate base material 2 by means of laminating directly a desired resin or a laminate film formed of desired resin layers to provide the laminate material (B). After the above mentioned waterproof layers 6 and 7 are formed, a hole 3 is formed through the laminate base material 2 and the outer and inner waterproof layers 6 and 7 at a predetermined position (C).

Next, the partial covering films 11 and 15 larger than the hole 3 are attached from the inside and outside the paper carton to cover the hole 3, and the partial covering films 11 and 15 are attached to each other inside the hole 3. The outer partial covering film 11 is attached to the outer waterproof layer 6 at the periphery of the hole 3, while the inner partial covering film 15 is attached to the inner waterproof layer 7 at the periphery of the pouring hole (D). Then, a spout portion 9 is formed through the attached portion 8 of the partial covering films 11 and 15 inside the hole 3 (E). No gap is formed at the flange portion of the spout portion 9 because the flange portions 12*a* and 16*a* of the partial covering films 11 and 15 are fused by heat. This heat sealing prevents the contents from entering into the inner peripheral surface defining the pouring hole. These partial covering films 11 and 15 are made of such synthetic resin that has good heat sealing properties relative to each other and to the waterproof layers 6 and 7.

After having formed the spout portion 9 in the manner described above, a paper carton is made of this laminate material. (The tab tape 10 may be previously sealed over the spout portion to cover it with the tab tape before forming the paper carton.) More specifically, a "carton blank" to be formed into the paper carton is filled with the contents by using a filling machine. After having finished filling, a tab tape 10 is heat-sealed as shown in (F) to the partial covering film 11 at the position corresponding to the outer waterproof layer 6 (outer peripheral portion of the partial covering film 11) to cover the spout portion 9. As a result, the spout portion 9 to be opened is provided and the paper carton is completely formed.

Figure 5:
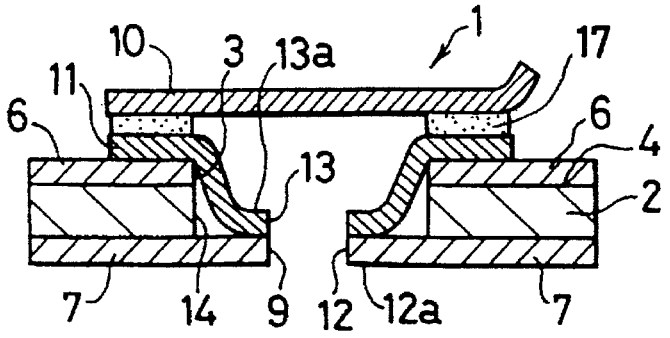
FIG. 5 is a view for use in describing the pouring spout having a heat sealed lacquer layer.

In order to ensure easy opening of the pouring spout 1, as shown in FIG. 5, a ring-shaped heat sealed lacquer layer 17 is provided on the outer surface of the outer partial covering film 11, corresponding to the position where the tab tape is to be attached. The tab tape 10 may be attached to the partial covering film 11 through this heat sealed lacquer layer 17. The heat sealed lacquer layer 17 may be formed by means of coating heat sealed lacquer of nitrocellulose resin on the partial covering film 11 by using the gravure printing technique.

The present invention has thus been described in conjunction with the partial covering films 11 and 15 in the pouring spout 1 formed as a single layer. However, in order to make the partial covering film more suitable to the portion of the pouring hole having no laminate base material with regard to gas barrier properties and water resistance, a multi-layered film arranged in pursuit for various properties such as gas barrier properties and water resistance may be used as a partial covering film.

Figure 6:
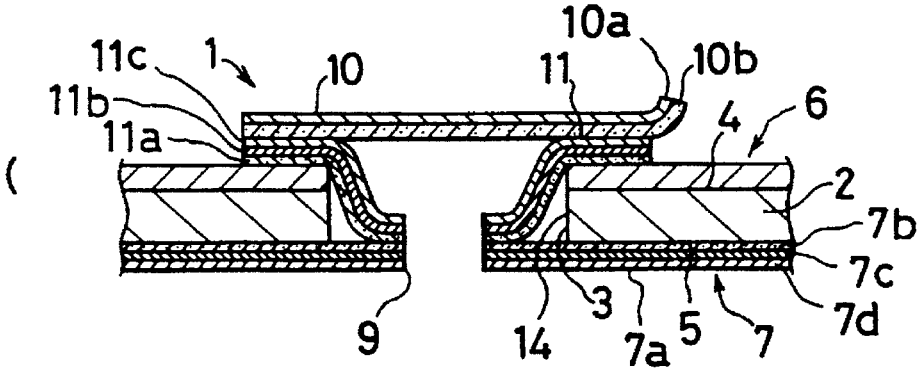
FIG. 6 is a view for use in describing the pouring spout with a partial covering film having a gas barrier film layer placed thereon.
Figure 7:
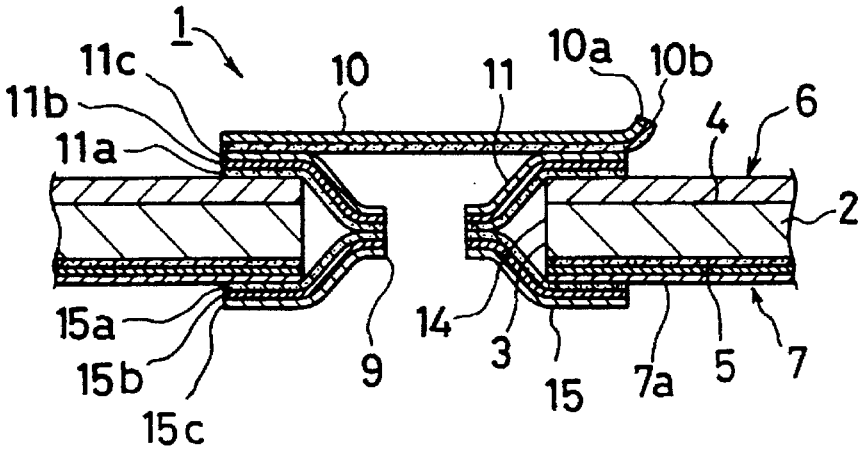
FIG. 7 is also a view for use in describing the pouring spout with a partial covering film having a gas barrier film layer placed thereon.

FIGS. 6 and 7 show another embodiment of the present invention for improving the gas barrier properties at the pouring spout 1. In the structure of the pouring spout in which the inner peripheral surface defining the pouring hole is covered with the combination of the partial covering film 11 extending from the outside the paper carton and the inner waterproof layer 7 attached thereto, as indicated in FIG. 6. The inner waterproof layer 7, which is formed by means of laminating the inner waterproof film 7*a* on the surface 5 of the laminate base material 2, is a laminate film formed of an adhesive resin layer 7*b*, a gas barrier film layer 7*c* having gas barrier properties, and a synthetic resin film layer 7*d* laminated n this order from the side of the laminate base material 2. The gas barrier film layer 7*c* may be formed of a silicon oxide deposited thin film and an aluminum thin film. While, the outer partial covering film 11 made by the multi-layered laminate film consists of, from the side of the laminate base material 2, an adhesive resin layer 11*a*, a gas barrier film layer 11*b* having gas barrier properties, and a synthetic resin film layer 11*c* laminated in this order. The gas barrier film layer 11*c* may be formed of a silicon oxide deposited thin film, and an aluminum thin film similarly to the above gas barrier film layer 7*c*. Then, the adhesive resin layer 7*b* of the inner waterproof layer film 7*a* and the adhesive resin layer 11*a* of the partial covering film 11 are heat sealed at the inner portion of the hole 3. As a result, the inner peripheral surface 14 is covered with the inner waterproof layer film 7*a* and the partial covering film 11. The tab tape 10 is constituted to have a barrier function such as shading or the gas barrier properties, and made by means of laminating a barrier layer 10*a* and an adhesive resin layer 10*b*.

The inner waterproof layer film 7*a* and the partial covering film 11 covering the inner peripheral surface 14 defining the pouring hole both have the gas barrier properties like this. Accordingly, oxygen which has arrived to the inner peripheral surface 14 defining the pouring hole after traveling through the outer waterproof layer 6 and the laminate base material 2, will not go through the inner waterproof layer film 7*a* and the partial covering film 11. As a result, it becomes possible to prevent the oxygen from entering into the paper carton. The tab tape 10 itself also has the gas barrier properties and no oxygen can go through this tab tape 10.

In the embodiment shown in FIG. 7, an outer waterproof layer 6 is laminated on one surface 4 outside the paper carton. At the same time, the inner waterproof layer 7 is formed on the other surface 5 inside the paper carton by means of laminating the inner waterproof layer film 7*a* having the gas barrier properties. Then, the hole 3 is bored penetrating through the laminate materials consisting of the outer waterproof layer 6, the laminate base material 2, and the inner-waterproof layer 7, with the partial covering films 11 and 15 attached thereto inside and outside the paper carton to cover the inner peripheral end surface 14 defining the pouring hole.

Both of the outer partial covering film 11 and the inner partial covering film 15 are the multi-layered laminate films having the gas barrier properties, which are made by means of laminating adhesive resin layers 11*a* and 15*a*, gas barrier film layers 11*b* and 15*b* having the gas barrier properties, synthetic resin film layers 11*c* and 15*c* in this order from the side of the laminate base material. Similarly to the above mentioned embodiment, the inner peripheral surface defining the pouring hole is covered with the partial covering films 11 and 15 having the gas barrier properties. Therefore, it is possible to prevent the contents from entering into the base material, and the oxygen which has arrived to the inner peripheral surface 14 of the pouring hole after traveling through the outer waterproof layer 6 and the laminate base material 2 can be prevented from entering into the paper carton.

Figure 8:
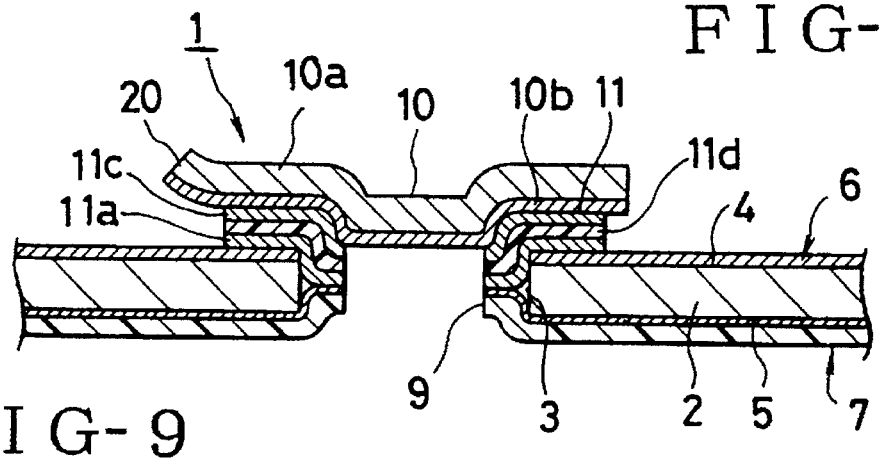
FIG. 8 is a view for use in describing the pouring spout with a partial covering film having a strong film layer placed thereon.
Figure 9:
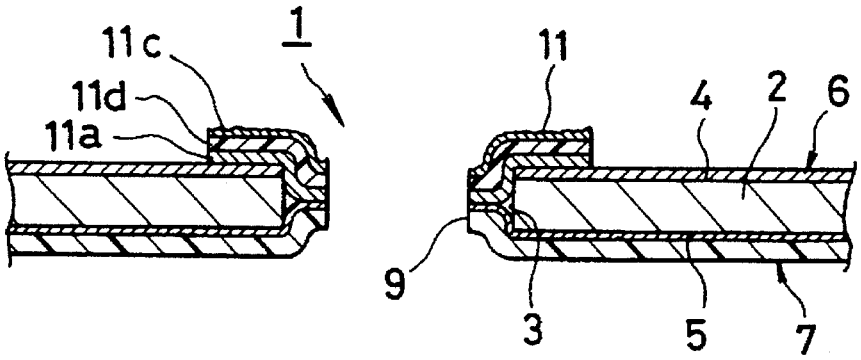
FIG. 9 is a view for use in describing the pouring spout without the tab tape.

With respect to the partial covering film 11 provided outside the paper carton, if the mechanical strength of the film will be improved, it is possible to prevent the resin from threading upon tearing off the tab tape. FIGS. 8 and 9 show yet another embodiment of the pouring spout 1, in which the inner peripheral surface 14 defining the pouring hole is covered with the outer partial covering film and the inner waterproof layer 7.

In this embodiment, the partial covering film 11 is the laminate film which has a multi-layered structure of an adhesive resin layer 11*a*, a tough film layer 11*d* that is a core of the partial covering film 11, and a synthetic resin film layer 11*c* laminated in this order from the side of the laminate base material 2. The tough film layer 11*d* may be formed of, for example, a polyester film or a nylon film.

Further, this film layer 11*d* is arrange to have toughness enough to stay on the side of the laminate base material 2 without being torn off along with the tab tape 10 at the time of opening the pouring spout 1, and it is arranged so that the torn-off may be occurred at the portion of the upper layer than the film layer 11*d* at the time of tearing off the tab tape 10. Like this, the film layer 11*d* is arranged to stay on the side of laminate base material 2 at the time of tearing off the tab tape 10. Therefore, the tab tape 10 can be torn off properly, and the resin face (synthetic resin layer 11*c*) around the window-shaped film 11 is not drawn at the time of tearing off the tap tape. Accordingly no damage is caused in the appearance of the pouring spout.

Figure 10:
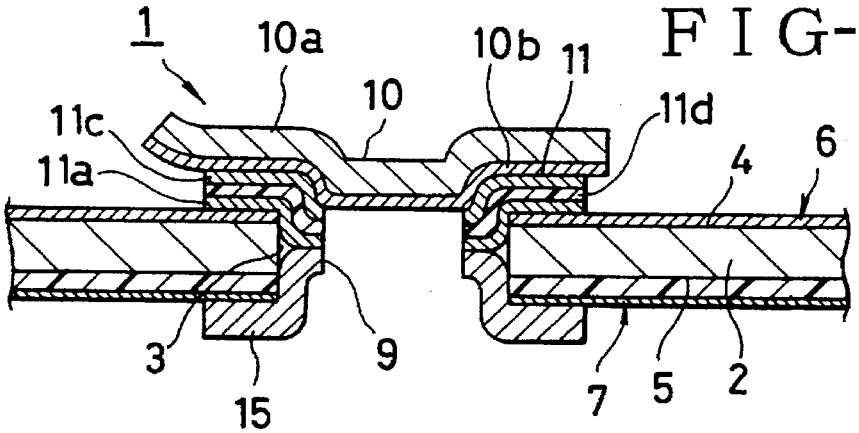
FIG. 10 is also a view for use in describing the pouring spout with a partial covering film having a strong film layer placed thereon.

FIG. 10 shows the pouring spout covered with the inner and outer partial covering films 11 and 15. Also in this embodiment, similarly to the above, the partial covering film 11 is a multi-layered laminate film, which has the structure of an adhesive resin layer 11*a*, a tough film layer 11*d* that is a core of the partial covering film 11, and a synthetic resin film layer 11*c* laminated in this order from the side of the laminate base material 2. The tough film layer 11*d* may be formed of, for example, a polyester film. Then, the film layer 11*d* is arranged to stay on the side of the laminate base material 2 at the time of tearing off the tab tape 10, the tab tape 10 can be torn off properly, and the resin face (synthetic resin layer 11*c*) around the window-shaped film 11 is not drawn at the time of tearing off the tap tape. Accordingly no damage is caused in the appearance of the pouring spout.

As described above, the partial covering film 11 which is provided outside can be formed in the multi-layered laminate film including a tough film of a good mechanical strength. Then, in the laminate film, because the strength of each layer is various, there is a layer which is detached from each other when the force of tearing off is applied thereto. Further, by selecting synthetic resin for the use of the laminate film, and by using the partial covering film (outer partial covering film) of multi-layers including a detachable layer of synthetic resin at the time of tearing off the tab tape, the peeling-off occurs inside the partial covering film at the time of opening the portion of the pouring spout, so to make the tear-off of the tab tape very easy and to prevent from giving damage to the laminate base material such as wound and break-down.

Figure 11:
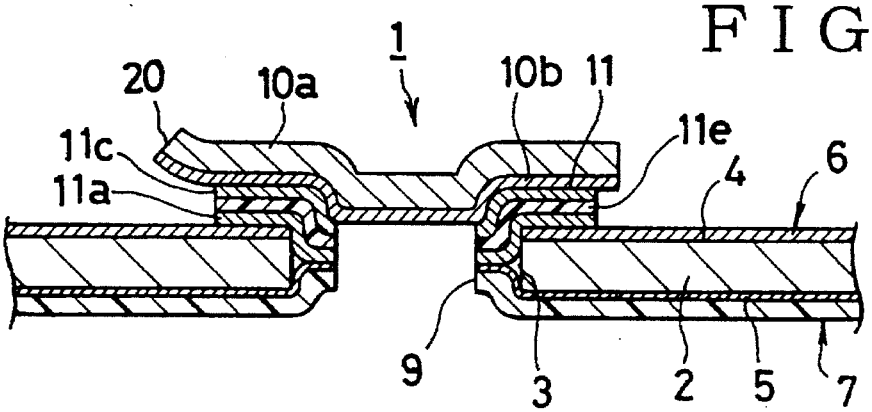
FIG. 11 is a view for use in describing the pouring spout with a partial covering film having a white colored layer placed thereon.

Moreover, in the portion of the pouring spout where the multi-layered partial covering film is attached outside the paper carton, a white colored area formed by a white film may be provided on the partial covering film, at the layer inside the boundary surface where the peeling-off occurs within the partial covering film at the time of tearing off the attached tab tape. The above white colored area can be emulsified by means of adding a white pigment to resin materials such as polypropylene, polyethylene, polyester having the heat sealing properties (for example, polyethylene terephthalate). Further, the white colored area may be formed by providing a printed layer such as white, milky or gray color on the film base. This embodiment is illustrated in FIG. 11, where the partial covering film 11 attached outside is formed by a multi-layered laminate film consisting of an adhesive resin layer 11*a*, a white colored film layer 11*e*, and a synthetic resin film layer 11*c* from the side of the laminate base material 2 laminated in this order, and layer peeling occurs at the synthetic resin film layer 11*c* at the time of tearing off the tab tape 10. Owing to this, though the synthetic resin film layer 11*c* becomes white at the time of tearing off the tape, the white colored film layer 11*e* beneath it is so white that the whitening phenomenon at the portion of peeling boundary does not appear visually to the outside, and when opening the portion of the pouring spout, the appearance thereof is not damaged. Then, this structure can be applied to the portion of the pouring spout where the partial covering films are attached from inside and outside.

As shown in FIGS. 12 and 13, the pouring spout having the above mentioned structure may be applied to a paper carton 18 having a cylindrical body.

In this paper carton 18, a top member 18*a* is obtained by the laminate materials, which is made by the extrusion-laminate of the low density polyethylene layer of 60 μm thick on the laminate base material facing inside and outside the surfaces thereof. The laminate base material is formed of a paper board layer (220 g/m$^2$), a polyethylene layer (20 μm thick), a polyethylene layer (15 μm thick), a biaxial oriented polyethylene terephthalate film layer (12 μm thick), and a silicon oxide deposited thin film layer (400 Å thick) laminated in this order from the outside of the paper carton to the inside of the paper carton. To this top member 18*a* with the open pore bored, as mentioned above, the partial covering films are attached from the inside and outside. Then, a spout portion 9 is formed therein, and a tab tape 10 is temporally attached thereto. Simultaneously, the upper end portion of the cylindrical body member 18*b* is wound around the peripheral end of the above top member 18*a* and is heat-sealed to provide a flange portion 19 upwardly extended around the top member 18*a*. The lower end portion of the cylindrical body member 18*b* is wound around the peripheral end of a bottom member 18*c* made by the laminate material and is heat-sealed to provide a flange portion 19 downwardly extended around the bottom member 18*c*. Then, after having filled the contents through the spout portion 9, so to cover the spout portion 9 with the Gab tape 10, the tab tape 10 is heat-sealed to the outer partial covering film, thereby making a paper carton with the pouring spout 1 closed. The inner surface of the carton may be sterilized by using a disinfectant such as hydrogen peroxide before filling the contents therein, and the disinfectant may be removed later to achieve the aseptic filling.

The tab tape 10 is extended beyond the flange portion 19 to provide a handy pick-up portion 20 by the extended portion lying on the surface of the body member 18*b* beyond the flange portion 19. By the use of this paper carton, it is possible to drink with your mouth attached to the portion of the pouring spout directly holding it by hand. As mentioned above, the tab tape 10 is extended beyond the flange portion 19 to cover the portion where the lips touch, thereby keeping there clean until opening. Further, providing the tab tape 10 with the pick-up portion 20, lifting operation of the tab tape becomes easy when opening the portion of the pouring spout.

Figure 15:
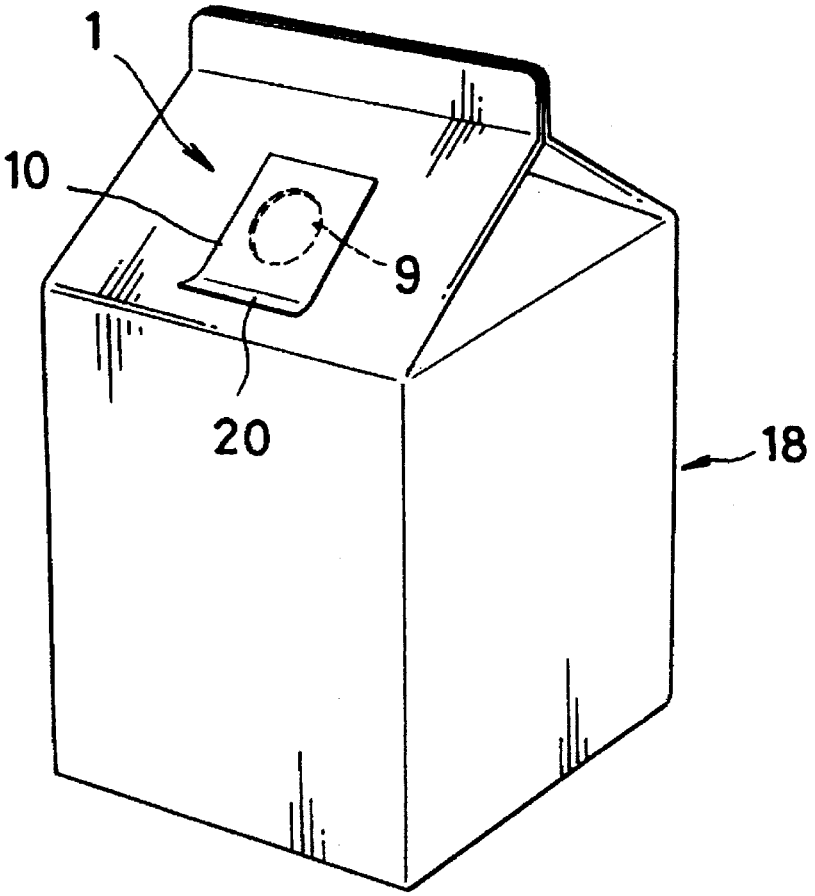
FIG. 15 is a view for use in describing a gable-top paper carton.

In the cylindrical paper carton, the pouring spout is formed such that the open pore is covered with the partial covering films from inside and outside. However, another type of the pouring spout such as those covering the open pore with the outer partial covering film and the inner waterproof film may be applied to this cylindrical paper carton. Then, as shown in FIG. 14, also in the paper carton 18 having a brick-shaped main body, the pouring spout 1 mentioned above may be formed on the top flat surface. Further, as shown in FIG. 15, also in the paper carton 18 having an inclined upper portion, what is called a gable-top, the portion of the pouring spout 1 mentioned above may be formed on the inclined top surface thereof.

What is claimed is:

1. A pouring spout structure of a paper carton comprising:

a laminate base material;

an outer waterproof layer formed on one surface facing outside the paper carton of said laminate base material, said laminate base material and said outer waterproof layer being provided with a pouring hole formed therein and penetrating therethrough;

an inner waterproof layer formed on the other surface facing inside the paper carton of said laminate base material, said inner waterproof layer being extended over the pouring hole and provided with an inner waterproof pouring hole formed therein and penetrating therethrough, the inner waterproof pouring hole being smaller than the pouring hole;

a partial covering film attached to said outer waterproof layer along the periphery of the pouring hole such that said partial covering film covers the pouring hole extending over the pouring hole, said partial covering film being provided with a partial covering film pouring hole formed therein and penetrating therethrough, the partial covering film pouring hole being smaller than the pouring hole and corresponding to the inner waterproof pouring hole, said inner waterproof layer and said partial covering film being attached as an attached portion at the periphery of the inner waterproof pouring hole and the partial covering film pouring hole;

a spout portion provided inside the pouring hole and defined by the edge of the attached portion, the attached portion covering the inner peripheral surface defining the pouring hole; and a tab tape removably attached to said partial covering film, said spout portion being covered with said tab tape.

2. A pouring spout structure of a paper carton comprising:

a laminate base material;

an outer waterproof layer formed on one surface facing outside the paper carton of said laminate base material;

an inner waterproof layer formed on the other surface facing inside the paper carton of said laminate base material, said laminate base material, said outer waterproof layer, and said inner waterproof layer being provided with a pouring hole formed therein and penetrating therethrough;

an outer partial covering film attached to said outer waterproof layer along the periphery of the pouring hole such that said outer partial covering film covers the pouring hole extending over the pouring hole, said outer partial covering film being provided with an outer partial covering film pouring hole formed therein and penetrating therethrough, the outer partial covering film pouring hole being smaller than the pouring hole;

an inner partial covering film attached to said inner waterproof layer along the periphery of the pouring hole such that said inner partial covering film covers the pouring hole extending over the pouring hole, said inner partial covering film being provided with an inner partial covering film pouring hole formed therein and penetrating therethrough, the inner partial covering film pouring hole being smaller than the pouring hole and corresponding to the outer waterproof pouring hole, said outer and inner partial covering films being attached as an attached portion at the periphery of the outer and inner partial covering film pouring holes;

a spout portion provided inside the pouring hole and defined by the edge of the attached portion, the attach portion covering the inner peripheral surface defining the pouring hole; and a tab tape removably attached to said outer partial covering film, said spout portion being covered with said tab tape.

3. A pouring spout structure of a paper carton as claimed in claim 1 or 2 further comprising a ring-shaped heat sealed lacquer layer provided on the outer surface of said outer partial covering film, said tab tape being removably attached to said partial covering film through said head seal lacquer layer.

4. A pouring spout structure of a paper carton as claimed in claim 1 or 2, wherein said partial covering film may have a multi-layered structure.

5. A pouring spout structure of a paper carton as claimed in claim 1, wherein said inner waterproof layer extended over the pouring hole and said inner partial covering film are formed in a multi-layered structure including a film having gas barrier properties.

6. A pouring spout structure of a paper carton as claimed in claim 2, wherein said inner and outer partial covering films are formed in a multi-layered structure including a film having gas barrier properties.

7. A pouring spout structure of a paper carton as claimed in claim 4, wherein said outer partial covering film is formed in a multi-layered structure including a film having a good mechanical strength.

8. A pouring spout structure of a paper carton as claimed in claim 4, wherein said outer partial covering film is formed in a multi-layered structure including layers to be separated from each other at the time of tearing off the tab tape.

9. A pouring spout structure of a paper carton as claimed in claim 1 or 2, wherein said outer partial covering film is formed in a multi-layered structure including a white colored film.

10. A paper carton as claimed in claim 1 or 2, wherein the paper carton has a brick shape with a top surface, and said pouring spout is provided in the top surface of the paper carton.

11. A paper carton as claimed in claim 1 or 2, wherein the paper carton has a gable-top shape with an inclined top surface, and said pouring spout is provided in the inclined top surface of the paper carton.

12. A paper carton as claimed in claim 1 or 2, wherein the paper carton has a cylindrical trunk portion with a circular top surface, and said pouring spout is provided the circular top surface of the paper carton.

13. A paper carton as claimed in claim 12, wherein the circular top surface has an outer flange portion, and said tab tape is extended outward from said pouring spout beyond said outer flange portion.

14. A paper carton as claimed in claim 11, wherein said tab tape has a picking-up portion at the distal end thereof.

15. A method of manufacturing a pouring spout of a paper carton comprising the steps of:

laminating an outer waterproof layer on one surface facing outside the paper carton of a laminate base material;

forming a pouring hole penetrating through the laminate base material and the outer waterproof layer;

laminating an inner waterproof layer on the other surface facing inside the paper carton of the laminate base material where the pouring hole was formed;

attaching a partial covering film which is larger than the pouring hole, from an exposed portion of the inner waterproof layer through the pouring hole to a flange portion of the outer waterproof layer around the pouring hole, thereby covering the inner peripheral surface defining the pouring hole with the inner waterproof layer and the partial covering film;

forming a spout portion penetrating through the partial covering film and the inner waterproof layer in the area where the partial covering film is attached to the inner waterproofing layer; and removably attaching a tab tape to the partial covering film to cover the spout portion with the tab tape.

16. A method of manufacturing a pouring spout of a paper carton comprising the steps of:

laminating an outer waterproof layer and an inner waterproof layer on one surface facing outside the paper carton of a laminate base material and the other surface facing inside the paper carton;

forming a pouring hole penetrating through the laminate base material, the outer waterproof layer, and the inner waterproof layer;

placing partial covering films outwardly and inwardly relative to the pouring hole, the partial covering films being larger than the pouring hole and attached to each other in the pouring hole, the partial covering film being also attached to the waterproof layers around the pouring hole for covering the inner peripheral surface with the inner and outer partial covering films;

forming a spout portion penetrating through the partial covering films in the area where the partial covering films are attached to each other; and removably attaching a tab tape to the partial covering film to cover the spout portion with the tab tape.

* * * * *